US010092087B2

(12) United States Patent
Zimmerman

(10) Patent No.: US 10,092,087 B2
(45) Date of Patent: Oct. 9, 2018

(54) SELF-RIGHTING TOOTHBRUSH

(71) Applicant: Israel Harry Zimmerman, Los Angeles, CA (US)

(72) Inventor: Israel Harry Zimmerman, Los Angeles, CA (US)

( * ) Notice: Subject to any disclaimer, the term of this patent is extended or adjusted under 35 U.S.C. 154(b) by 198 days.

(21) Appl. No.: 15/173,309

(22) Filed: Jun. 3, 2016

(65) Prior Publication Data

US 2017/0347791 A1 Dec. 7, 2017

(51) Int. Cl.
*A46B 9/04* (2006.01)
*A46B 15/00* (2006.01)

(52) U.S. Cl.
CPC ..... *A46B 15/0097* (2013.01); *A46B 9/04* (2013.01); *A46B 2200/1066* (2013.01)

(58) Field of Classification Search
CPC ..... A46B 15/0097
USPC ..... 15/143.1, 167.1
See application file for complete search history.

(56) References Cited

U.S. PATENT DOCUMENTS

| | | | |
|---|---|---|---|
| 2,722,703 | A | 11/1955 | Green |
| 3,968,950 | A | 7/1976 | Gallo |
| 5,228,166 | A | 7/1993 | Gomez |
| 5,517,713 | A | 5/1996 | Hadcock |
| 5,860,190 | A | 1/1999 | Cano |
| 5,956,796 | A | 9/1999 | Lodato |
| 6,490,760 | B1 | 12/2002 | Lauer et al. |
| 7,007,335 | B1 | 3/2006 | Doat |
| 7,527,446 | B2 | 5/2009 | Johnson Papa et al. |
| 8,650,697 | B2 | 2/2014 | Lombardi |
| 8,769,832 | B1 | 7/2014 | Joyner |
| 9,861,187 | B2 | 1/2018 | Zimmerman |
| 2004/0025272 | A1 | 2/2004 | Svartzak |
| 2004/0143920 | A1 | 7/2004 | Nanda |
| 2007/0039109 | A1 | 2/2007 | Nanda |

(Continued)

FOREIGN PATENT DOCUMENTS

| | | |
|---|---|---|
| CH | 703696 | 3/2012 |
| DE | 202011002076 U1 | 9/2011 |
| GB | GP2443888 A | 5/2008 |

(Continued)

OTHER PUBLICATIONS

PCT International Searching Authority, International Search Report and Written Opinion, PCT International Application No. PCT/US2016/052135, dated Feb. 13, 2017.

(Continued)

*Primary Examiner* — Laura C Guidotti
(74) *Attorney, Agent, or Firm* — Walter W. Duft

(57) ABSTRACT

A self-righting toothbrush includes a head section mounting a set of frontwardly extending bristles and a tail section having a rearwardly extending lateral asymmetry. A medial section has a pivot surface that allows the toothbrush to pivot and roll on a horizontal support surface. The head and tail sections have respective centers of mass. In a non-bristles up position, one or both of the head and tail section centers of mass are spaced from a vertical plane that includes a pivot point where the pivot surface contacts the support surface and is perpendicular to a toothbrush rolling direction. Due to a moment imbalance dominated by the tail section center of mass, a rotational moment induces the toothbrush to pivot about the neutral pivot axis to a bristles up position in which both centers of mass are aligned in the vertical plane.

20 Claims, 8 Drawing Sheets

(56) References Cited

U.S. PATENT DOCUMENTS

| | | | |
|---|---|---|---|
| 2008/0311282 | A1 | 12/2008 | Hammon |
| 2014/0053357 | A1 | 2/2014 | Barzel |

FOREIGN PATENT DOCUMENTS

| | | |
|---|---|---|
| WO | WO9833789 | 9/1998 |
| WO | WO9844823 | 10/1998 |

OTHER PUBLICATIONS

PCT International Searching Authority, International Search Report and Written Opinion, PCT International Application No. PCT/US2017/051737, dated Feb. 1, 2018.

PCT International Searching Authority, Notification Concerning Transmittal of International Preliminary Report on Patentability (Chapter 1 of the Patent Cooperation Treaty), PCT International Application No. PCT/US2016/052135, dated Mar. 29, 2018.

SELF-RIGHTING TOOTHBRUSH

BACKGROUND

1. Field

The present disclosure relates to toothbrush technology. More particularly, the disclosure is directed to improvements in toothbrush sanitation.

2. Description of the Prior Art

By way of background, toothbrushes have become evergreen products and a vital tool necessary for oral health. At the same time, given the environment that toothbrushes are used in, cleanliness is a crucial element of safe use. It is well known that the mouth, and the gums in particular, are efficient portals for transporting bacteria through the body, which is why some people with certain health issues are required to take antibiotics prior to certain dental procedures.

The standard toothbrush has an elongated shaft with bristles attached to one end and the other end forming a handle. In a typical bathroom environment, a toothbrush is often placed on surfaces that harbor bacteria and other microorganisms, such as on a counter top next to a sink, on a shelf in a medicine cabinet, in a drawer, etc. Unless the toothbrush is placed on the surface with the bristles facing up, the bristles can contact the surface and any microorganisms that may be present thereon can transfer to the bristles and subsequently enter the mouth. Notwithstanding the foregoing, toothbrush users at one time or another have placed their toothbrushes onto counter tops where the bristle end of the toothbrush is either laid on its side or face down. This is particularly pronounced with younger children that may not be as cognizant of hygienic protocol.

It is to improvements in toothbrush sanitation that the present disclosure is directed. In particular, a self-righting toothbrush is disclosed that is configured to pivot to a bristles up position in most instances when the toothbrush is dropped or placed onto a surface.

SUMMARY

A self-righting toothbrush includes a head section, a tail section and a medial section. The medial section is disposed at a junction of the head section and the tail section in a longitudinal direction of the toothbrush. The head section mounts a set of bristles that extend in a frontward direction. The tail section has a lateral asymmetry that extends in a rearward direction that is generally opposite to the frontward direction. The medial section has a pivot surface configured to contact a horizontal support surface at a pivot point. The pivot point represents the location on the pivot surface that is in contact with the support surface at any given rotational position of the toothbrush. The pivot surface allows the toothbrush to undergo pivoting and rolling on the support surface, with the direction of rolling being perpendicular to a longitudinal axis that lies in a common vertical plane with the pivot point, with the vertical plane also being perpendicular to the direction of rolling.

The head section and the tail section have a respective head section center of mass and a tail section center of mass. When the toothbrush is in a bristles up position in which the bristles extend vertically away from the support surface, the head section center of mass and the tail section center of mass are substantially aligned in the vertical plane that includes the pivot point, such that the toothbrush is in a stable non-rolling orientation. When the toothbrush is in a non-bristles up position, such as when the bristles are oriented generally horizontally, the tail section center of mass becomes laterally spaced from the vertical plane and assumes non-neutral unstable position due to the rearward lateral asymmetry. This produces a rotational moment that induces the toothbrush to roll to the bristles up position.

The head section center of mass may also become laterally spaced from the vertical plane so as to assume non-neutral positions and produce a rotational moment. If the head section center of mass and the tail section center of mass are on opposite sides of the vertical plane in one or more positions of the toothbrush, the respective tail section and head section rotational moments will be in opposition to each other in such positions. However, the toothbrush may be configured so that the rotational moment produced by the tail section center of mass is dominant. If the head section center of mass and the tail section center of mass are on the same side of the vertical plane in one or more positions of the toothbrush, the respective head section and tail section rotational moments will act in concert with one another in such positions.

In another aspect, the toothbrush may be configured with a tail-down bias in which the head section does not contact the support surface after the toothbrush comes to rest in the bristles up position, or at any other rotational position of the toothbrush.

In another aspect, the pivot surface may include a rearward protrusion, a lateral protrusion on each side of the rearward protrusion, and a frontward protrusion. The rearward protrusion, the lateral protrusions and the frontward protrusion may form a substantially continuous curve of selected shape.

In another aspect, the frontward protrusion may be generally dome-shaped and sized to prevent the head section from contacting the support surface when the toothbrush is in a bristles down position in which the bristles extend vertically toward the support surface.

In another aspect, the frontward protrusion may include a protuberance at a central peak portion thereof to provide rotational instability when the toothbrush in a bristles down position in which the bristles extend vertically toward the support surface. The pivot surface may thereby have a generally acorn-like cross-sectional configuration.

In another aspect, the frontward protrusion may include a concavity on a tail-end surface thereof that faces the tail section.

In another aspect, the rearward protrusion may be longitudinally distributed. The longitudinally distributed rearward protrusion may include one or more ridges.

In another aspect, the rearward protrusion may be large enough to allow a base portion of the head section to angle rearwardly.

In another aspect, the rearward protrusion may include a rearward lateral asymmetry of the toothbrush.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
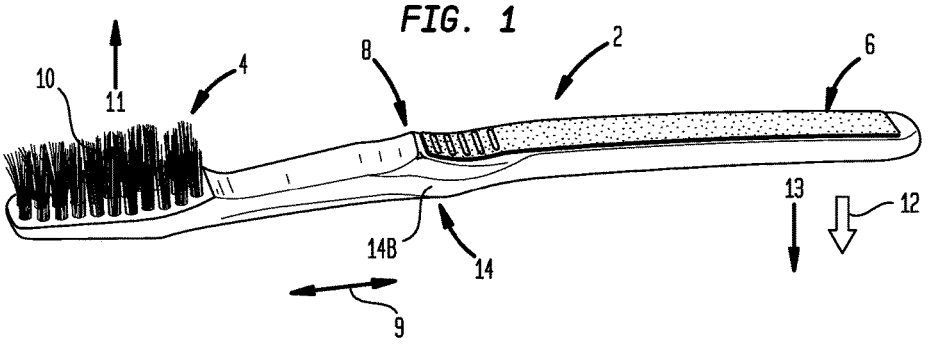
FIG. 1 is a perspective view showing an example embodiment of a self-righting toothbrush that may be constructed in accordance with the present disclosure.

Turning now to the drawing figures, in which like reference numbers illustrate like structure in all of the several views, FIGS. 1-4 illustrate an example embodiment of a self-righting toothbrush 2 having a head section 4, a tail section 6, and a medial section 8. The medial section 8 is disposed at a junction of the head section 4 and the tail section 6 in a longitudinal direction 9 of the toothbrush 2. The distal end of the head section 4 mounts a set of bristles 10. Unless otherwise indicated, the materials used to fabricate the toothbrush 2 are the same as may be found in conventional toothbrushes, which are mainly plastics such as polypropylene or polyethylene for the rigid non-bristle component(s), and Nylon for the bristles.

Figure 2:
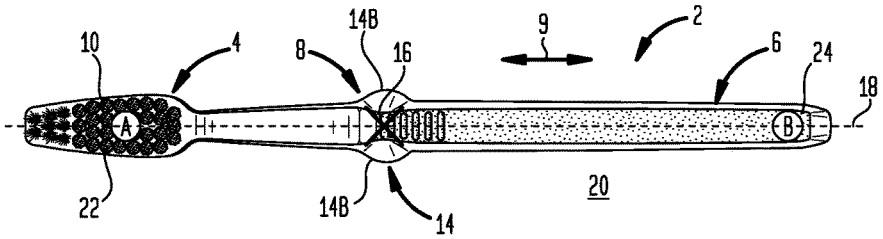
FIG. 2 is a plan view showing the front of the toothbrush of FIG. 1 with the rear of the toothbrush resting on a horizontal support surface in a bristles up position.
Figure 3:
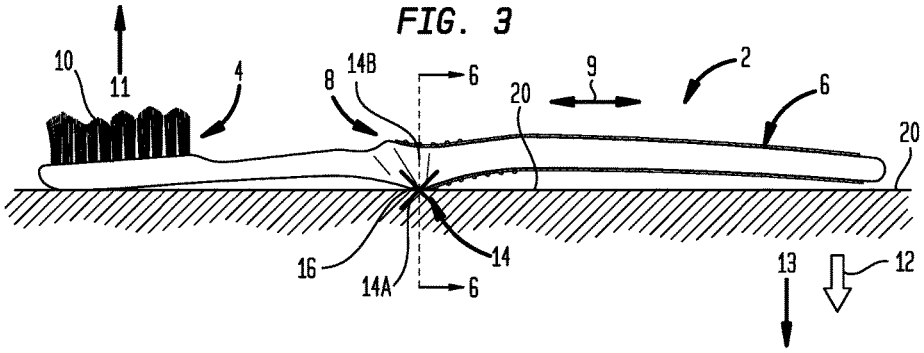
FIG. 3 is a side view of the toothbrush of FIG. 1 with the toothbrush positioned as in FIG. 2 with the rear of the toothbrush resting on the support surface in a bristles up position.
Figure 4:
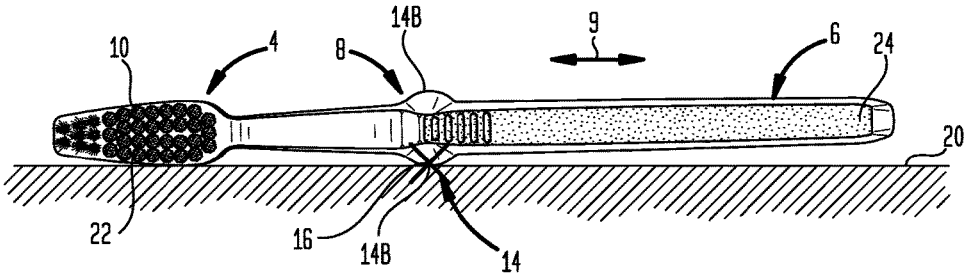
FIG. 4 is a side view of the toothbrush of FIG. 1 with a side edge of the toothbrush resting on the support surface in a non-bristles up position.
Figure 5:
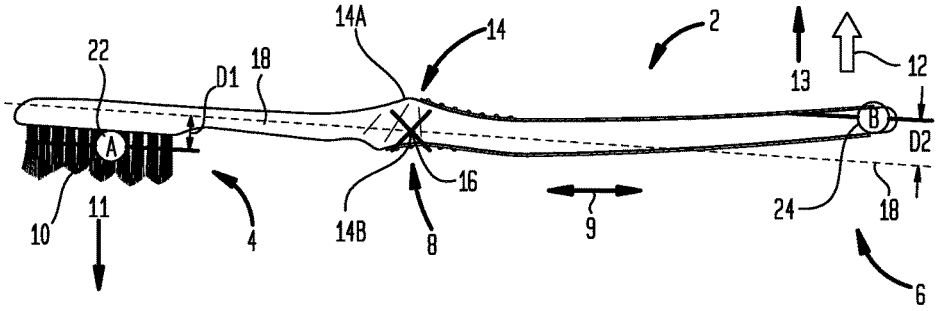
FIG. 5 is a plan view of the toothbrush of FIG. 1 positioned as in FIG. 4 with a side edge of the toothbrush resting on the support surface in a non-bristles up position.

As can be seen in FIGS. 1, 3 and 5, the bristles 10 extend in a frontward direction 11 of the toothbrush 2, starting from their point of attachment to the head section 4. The tail section 6 has a lateral asymmetry 12 that extends in a rearward direction 13 of the toothbrush 2, which is generally opposite to the frontward direction. Is so desired, the head section 4 may also have some degree of lateral asymmetry in the rearward direction 12. The medial section 8 has a pivot surface 14 that contacts a horizontal support surface 20 at a pivot point 16 (see FIGS. 2-5) when the toothbrush is placed on the support surface. The pivot point 16 is situated on the pivot surface 14 and represents its instantaneous point of contact with the support surface 20 at any given rotational position of the toothbrush 2. As described in more detail below, the pivot surface 14 allows the toothbrush 2 to undergo pivoting so as to roll the toothbrush on the support surface 20. It will be appreciated that as such rolling occurs, the pivot point's location on the pivot surface 14 will change as different regions of the pivot surface come into contact with the support surface 20.

For reference purposes, the plan views of FIGS. 2 and 5 depict a longitudinal axis 18 that is aligned with the pivot point 16 in a common vertical plane for any rotational position of the toothbrush 2. The longitudinal axis 18 is oriented substantially perpendicular to the direction in which the toothbrush rolls as it pivots. In most cases, the longitudinal axis 18 will extend generally in the elongated longitudinal direction 9 of the toothbrush. The vertical plane that includes the pivot point 16 and the longitudinal axis 18 will likewise be substantially perpendicular to the direction of toothbrush rolling.

Figure 6:
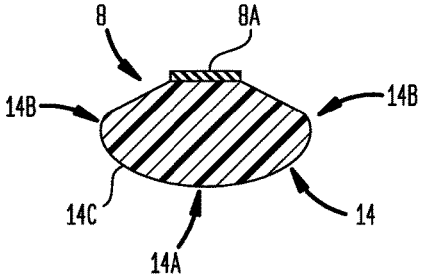
FIG. 6 is a cross-sectional view taken along line 6-6 in FIG. 3 through the medial section of the toothbrush of FIG. 1.

In the disclosed embodiment of FIG. 1, the pivot surface 14 may include a rearward protrusion 14A and two lateral protrusions 14B, one on each side of the rearward protrusion (see FIGS. 2, 3 and 4). As shown in FIG. 6, the pivot surface 14 may have a substantially continuous curve 14C of selected shape (e.g., circular, oval, etc.) that extends between the lateral protrusions 14B, and through the rearward protrusion 14A. This configuration allows the toothbrush 2 to roll smoothly on the support surface 20. If desired, the pivot surface 14 may terminate at the lateral protrusions 14B, such that there is no pivot surface per se on the front side of the medial section 8. The range of pivoting and rolling will then lie between positions in which the toothbrush 2 is oriented in a non-bristles up position with the bristles 10 extending generally horizontally and parallel to the support surface 20. FIGS. 4 and 5 represent the first such bristles sideways position. The second such bristles sideways position is when the toothbrush 2 is pivoted 180° from the position shown in FIGS. 4 and 5. In these positions, the tail section's rearward lateral asymmetry 12 also extends generally horizontally and parallel to the support surface 20, as shown in FIG. 5. The midpoint of the range of pivoting and rolling is a bristles up position in which the bristles 10 extend vertically away from and perpendicular to the support surface and the tail section's rearward lateral asymmetry 12 extends toward the support surface, as shown in FIGS. 2 and 3.

Figure 11:
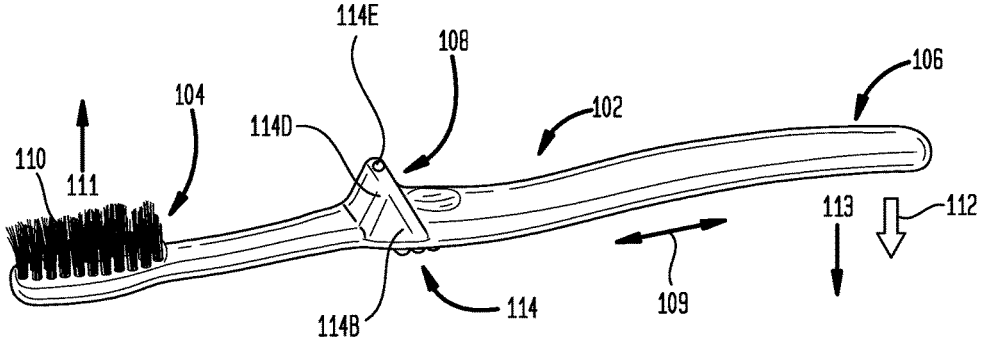
FIG. 11 is a perspective view showing another example embodiment of a self-righting toothbrush that may be constructed in accordance with the present disclosure.

As shown in FIG. 6, the front side of the medial section 8 may angle toward a flat front surface that may be ridged to provide a thumb grip 8A of the toothbrush 2. It will be appreciated that without a pivot surface on the front side of the medial section 8, the toothbrush 2 will not naturally pivot from a strictly bristles down position in which the bristles extend directly toward the support surface 20. In this position, the ends of the bristles 10 may rest on the support surface 20 as a first point of contact, and a second point of contact may be somewhere along the front side of the tail section 6. Depending on its size, the front side of the medial section 8 may or may not contact the support surface 20. In either case, pivoting may be effectively prevented in the bristles down position. This may be advantageous in that 360 degree pivoting, which could cause the toothbrush 2 to roll off the support surface 20, is prevented. On the other hand, if it is desired to extend the range of pivoting toward and possibly including the bristles down position, the pivot surface 14 may be extended to include some or all of the front side of the medial section 8. This is illustrated in the embodiment of FIG. 11, described in more detail below. It should be noted that for the bristles up position, stability and resistance to 360 degree rolling is provided by the somewhat flattened surface contour 14C near the midpoint of the rearward protrusion 14A. This surface flattening can be seen in FIG. 6. Further flattening of the rearward protrusion 14A would add additional stability. This is illustrated in the embodiment of FIG. 11.

As shown in FIGS. 2 and 5, the head section 4 and the tail section 6 of the toothbrush 2 have a respective head section center of mass 22 (Mass "A") and a tail section center of mass 24 (Mass "B"). When the toothbrush 2 is in a bristles up position, as shown in FIG. 2, the head section center of mass 22 and the tail section center of mass 24 are substantially aligned with the pivot point in a stable non-pivoting orientation. In particular, the head section center of mass 22 and the tail section center of mass 24 lie substantially in the vertical plane that includes the longitudinal axis 18 and the pivot point 16. It will be appreciated that the same alignment occurs when the toothbrush is rotated 180 degrees to the bristles down position. When the toothbrush 2 is in a non-bristles up position, such as when the bristles are oriented generally horizontally as shown in FIG. 5 (the bristles sideways position), the tail section center of mass 24 assumes non-neutral unstable positions. In particular, the tail section center of mass 24 is laterally spaced from the vertical plane that includes the longitudinal axis 18 and the pivot point 16. The head section center of mass 22 may also assume non-neutral positions on the same or opposite side of the same vertical plane.

In FIG. 5, the head section center of mass 22 is laterally spaced from the longitudinal axis 18 on a first side thereof by a distance "D1." The tail section center of mass 24 is laterally spaced from the longitudinal axis 18 on a second side thereof by a distance "D2." The non-neutral positions of the head section center of mass 22 and the tail section center of mass shown in FIG. 5 produce respective rotational moments that are in opposition to each other. A head section rotational moment (MomentA), which equals MassA×D1, urges the toothbrush 2 to pivot toward a bristles down position in which the bristles 10 extend generally toward the support surface 20. A tail section rotational moment (MomentB), which equals MassB×D2, urges the toothbrush 2 to pivot toward a bristles up position. By designing the toothbrush 2 so that MomentB than MomentA, a moment differential or imbalance is created that results in a net rotational moment (MomentNet) dominated by MomentB. MomentNet tends to induce the toothbrush 2 to pivot about the pivot point 16 to the bristles up position in which the bristles 10 extend vertically away from the support surface 20.

Designing the toothbrush 2 to produce a net rotational moment that induces pivoting to a bristles up position may be implemented by controlling the size and/or location of head section center of mass 22 and the tail section center of mass 24. In this regard, it should be understood that the head section center of mass 22 will be defined by all toothbrush structure that extends from the pivot point 16 to the distal end of the head section 4 (which may include a portion of the medial section 8). Similarly, the tail section center of mass 24 will be defined by all toothbrush structure that extends from the pivot point 16 to the distal end of the tail section 6 (which may include a portion of the medial section 8). In effect, the head section 4 and the tail section 6 meet at the pivot point 16. The medial section 8 may be thought of as representing the pivot point 16 and the regions of the head section 4 and the tail section 6 that lie on either side of the pivot point 16 and define the pivot surface 14.

If the head section center of mass 22 and the tail section center of mass 24 are on opposite sides of the longitudinal axis 18, the net rotational moment may be provided at least in part by spacing the tail section center of mass 24 further from the neutral pivot axis 18 than the head section center of mass 22. Alternatively, or in addition, the net rotational moment may be provided at least in part by making the tail section center of mass 24 heavier than the head section center of mass 22. Another way to create a favorable net rotational moment is to configure the toothbrush 2 so that the head section center of mass 22 is directly aligned with the longitudinal axis 18, so as to produce no head section rotational moment. Alternatively, as mentioned above, the toothbrush 2 could be configured so that the head section center of mass 22 and the tail section center of mass 24 are both on the same side of the longitudinal axis 18. This will be on the rearward side of the toothbrush 2, i.e., in the rearward direction 13 from the longitudinal axis 18.

The non-neutral location of the head section center of mass 22 in FIG. 5 is due largely to the weight of the bristles extending in the frontward direction 11 from their point of attachment to the structural portion of the head section 4. The location and weight of the head section center of mass 22 may thus be varied according to the size and weight of the bristles 10. The angle of the head section 4 is also a factor. In the bristles sideways position of FIG. 5, the structural portion of the head section 4 to which the bristles are attached is substantially aligned with the longitudinal axis 18. It will be appreciated that shifting the head section 4 rearwardly or forwardly relative to the FIG. 5 position would shift the head section center of mass 22 toward or away from the neutral pivot axis 18, thereby varying the head section MomentA.

The non-neutral location of the tail section center of mass 24 is due to the rearward lateral asymmetry 12 of the tail section 6. It will be appreciated that the tail section's rearward lateral asymmetry 12 may be provided in various ways. For example, the asymmetry 12 may include some or all of the distal end of the tail section 6 being angled or curved rearwardly away from the longitudinal axis 18 when the toothbrush 2 is in the bristles sideways position of FIG. 5. As shown in FIG. 5, when the toothbrush 2 is in the bristles sideways position, the portion of the tail section 6 that merges with the medial section 8 may be situated on the longitudinal axis 18 or even extend frontwardly thereof. This is permissible so long as some other portion of the tail section 6, such as its distal end, extends rearwardly from the longitudinal axis 18.

Other configurations for establishing the location of the tail section center of mass are also possible. For example, recalling that the tail section center of mass 24 is defined by all toothbrush structure extending from the pivot point 16 to the distal end of the tail section 6 (which includes a portion of the medial section 8), the rearward lateral asymmetry could be formed closer to the pivot point than is shown in FIG. 5. In that case, there might be no asymmetry at the distal end of the tail section 6. Alternatively, as illustrated by the embodiment of FIG. 11 (described below), a toothbrush configuration could be provided that includes two (or more) rearward lateral asymmetries (see, e.g., reference numbers 124 and 126 in FIG. 12). Changing the weight of the tail section 6 is another way to adjust the tail section MomentB. This could be accomplished in various ways, such as using a different (e.g., more dense) material, adding ballast, etc.

A further design consideration for the toothbrush 2 is the positioning of its head and tail sections 4 and 6 relative to the support surface 20 when the toothbrush is resting on the support surface. This is referred to herein as head-tail bias. In FIG. 3, the toothbrush 2 is configured with a head-down bias in which only the pivot point 16 and a portion of the head section 4 touches the support surface 20 after the toothbrush comes to rest in the bristles up position. As shown in FIG. 4, the head-down bias may also exist during pivoting and rolling of the toothbrush 2, so long as this does not interfere with the rotation.

Figure 7:
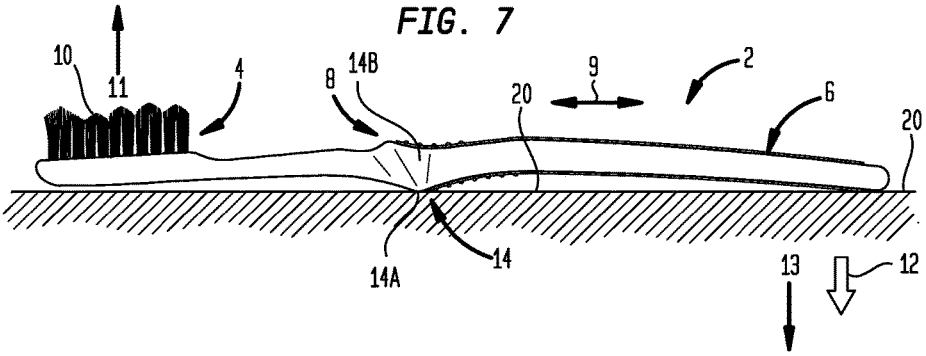
FIG. 7 is a side view of the toothbrush of FIG. 1 with the rear of the toothbrush resting on the support surface in a bristles up position, and with the toothbrush configured with a tail-down bias.

In another aspect, shown in FIG. 7, the toothbrush 2 may be configured with a tail-down bias in which only the pivot point 16 and a portion of the tail section 6 touches the support surface after the toothbrush comes to rest in the bristles up position. The tail-down bias may also exist during pivoting and rolling of the toothbrush 2, so long as this does not to interfere with the rotation.

Figure 8:
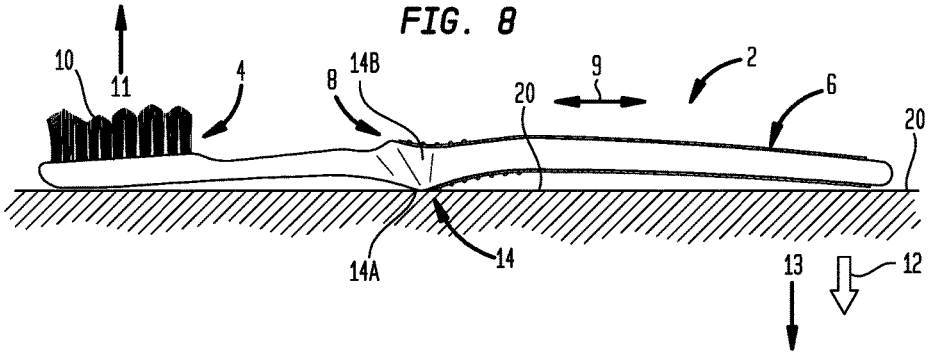
FIG. 8 is a side view of the toothbrush of FIG. 1 with the rear of the toothbrush resting on a support surface in a bristles up position, and with the toothbrush configured with a first type of neutral bias.
Figure 9:
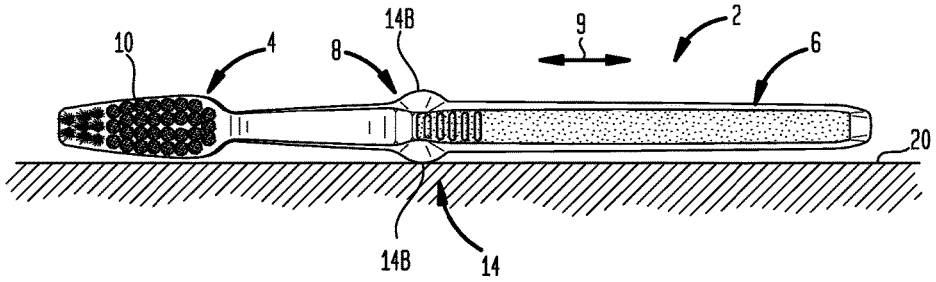
FIG. 9 is a side view of the toothbrush of FIG. 1 with a side edge of the toothbrush resting on the support surface in a non-bristles up position, and with the toothbrush configured with the first type of neutral bias.

In a further aspect, shown in FIG. 8, the toothbrush 2 may be configured with a first type of neutral bias in which neither the head section 4 nor the tail section 6 touches the support surface after the toothbrush comes to rest in the bristles up position. The first neutral bias may also exist during pivoting and rolling of the toothbrush 2, as shown in FIG. 9.

Figure 10:
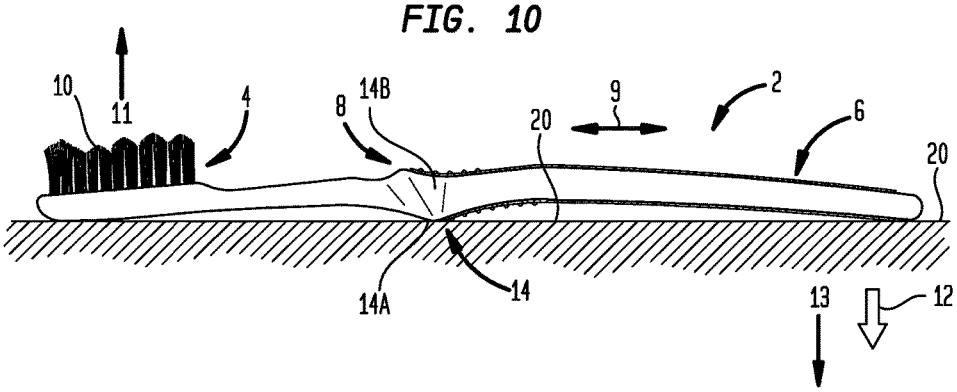
FIG. 10 is a side view of the toothbrush of FIG. 1 with the rear of the toothbrush resting on the support surface in a bristles up position, and with the toothbrush configured with a second type of neutral bias

In a further aspect, shown in FIG. 10, the toothbrush 2 may be configured with a second type of neutral bias in which both the head section 4 and the tail section 6 touch the support surface after the toothbrush comes to rest in the bristles up position. During pivoting and rolling of the toothbrush 2, at least one of the head section 4 or the tail section 6 will typically not touch the support surface 20 so as not to interfere with the rotation. Alternatively, both the head section 4 and the tail section 6 could be allowed to touch the support surface 20 during pivoting and rolling, so long as such touching does not interfere with the rotation.

Figure 14:
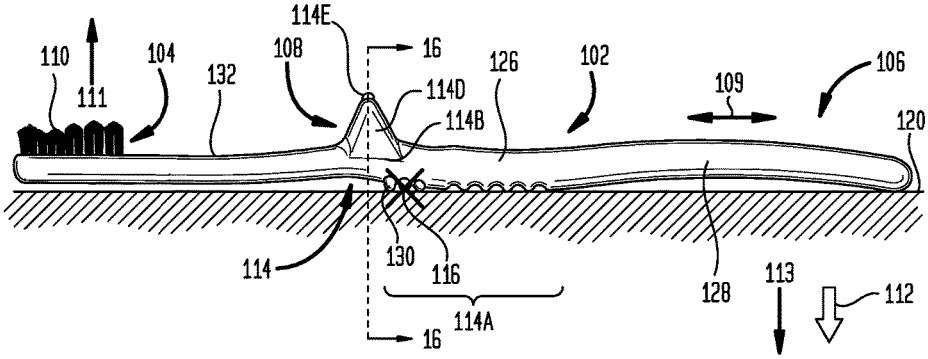
FIG. 14 is a side view of the toothbrush of FIG. 11 with the toothbrush positioned as in FIG. 12 with the rear of the toothbrush resting on the support surface in a bristles up position.
Figure 15:
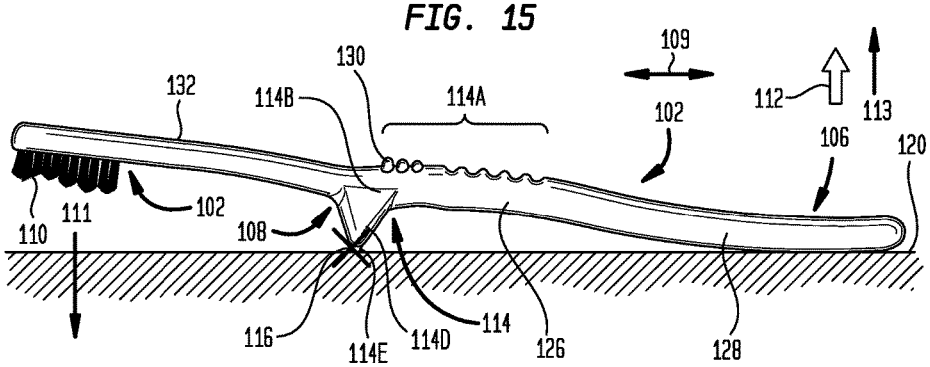
FIG. 15 is a side view of the toothbrush of FIG. 11 with the toothbrush resting on the support surface in a bristles down position.

Turning now to FIGS. 11-18, another example embodiment of a self-righting toothbrush 102 is shown. The toothbrush 102 is similar in construction to the toothbrush 2 of FIGS. 1-10, and corresponding structure is indicated by corresponding reference numbers that have been incremented by 100. A principle difference between the toothbrushes 2 and 102 is that the latter has a modified medial section 108 in which the pivot surface 114 extends beyond the lateral protrusions 114B on the front side of the toothbrush. In particular, the pivot surface 114 includes an enlarged frontward protrusion 114D that is sized to prevent the bristles 110 from contacting a horizontal support surface 120 when the toothbrush 102 is in the bristles down position (as shown in FIG. 15). A further feature of the toothbrush 102 is that is has a permanent tail down bias in which the head section 104, or at least the distal end thereof that mounts the bristles, never touches the support surface 120 in any rotational position of the toothbrush.

Figure 12:
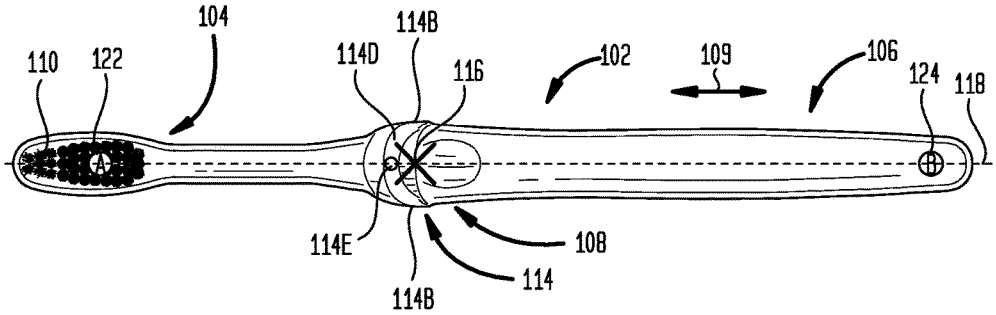
FIG. 12 is a plan view showing the front of the toothbrush of FIG. 11 with the rear of the toothbrush resting on a horizontal support surface in a bristles up position.
Figure 13:
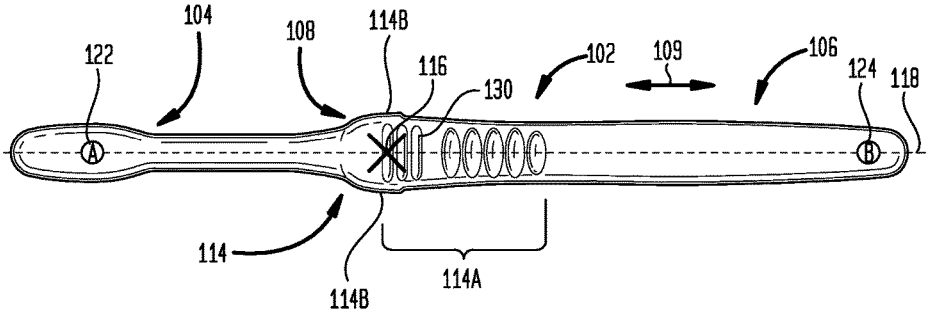
FIG. 13 is a plan view showing the rear of the toothbrush of FIG. 11 with the front of the toothbrush resting on the support surface in a bristles down position.
Figure 16:
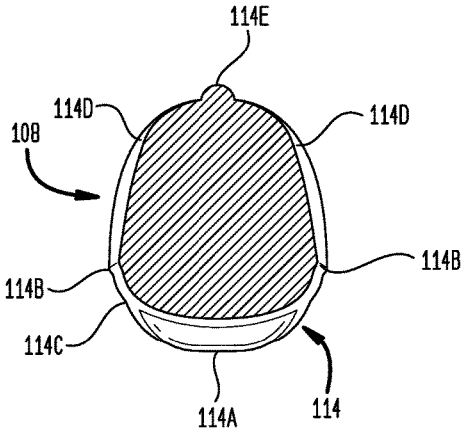
FIG. 16 is a cross-sectional view taken along line 16-16 in FIG. 14.
Figure 17:
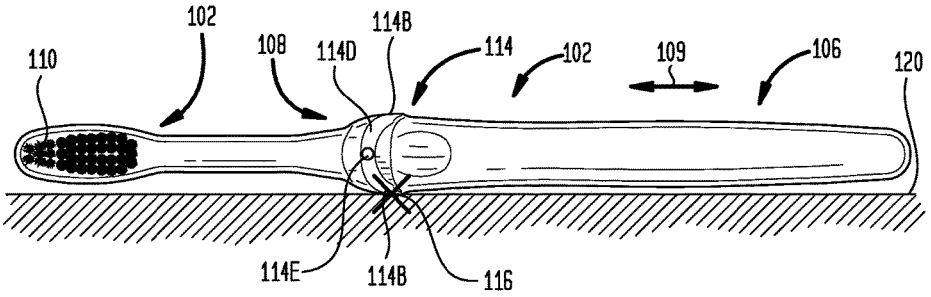
FIG. 17 is a side view of the toothbrush of FIG. 1 with a side edge of the toothbrush resting on the support surface in a non-bristles up position.

As can be seen in FIG. 16, the frontward protrusion 114D may have a slightly elongated, generally dome-shaped cross-sectional configuration. As can be seen in FIGS. 14 and 15, the frontward protrusion 114D may have a generally triangularly shaped side view configuration provided by a relatively wide lower base portion that tapers to a relatively thin terminal portion. As can be seen in FIGS. 11, 12 and 17, frontward protrusion 114D may have a convex configuration on a head-facing side thereof that faces the head section 104 of the toothbrush 102, and a concave configuration on a tail-facing side that faces the tail section 106 of the toothbrush. Advantageously, the concave configuration of the tail-facing side of the frontward protrusion 114D may be used to accommodate the thumb of a toothbrush user while brushing the teeth. The frontward protrusion 114D also aids in preventing liquid material present at the head end of the toothbrush 102 from dripping onto the user's hand during teeth brushing.

In the event that the toothbrush 102 is placed on the support surface 120 with the bristles 110 oriented anywhere below horizontal (parallel to the support surface), the medial section 108 of the toothbrush will come into contact with the support surface 120 at a pivot point 116 that lies somewhere on the frontward protrusion 114D. Due to its generally dome-shaped configuration, the frontward protrusion 114D allows the toothbrush 2 to undergo pivoting so as to roll on the support surface 120.

If desired, an optional protuberance 114E of relatively small size may be formed on the central peak of the frontward protrusion 114D. The protuberance 114E interrupts the otherwise smooth curvature of the frontward protrusion, and thereby provides instability to minimize the possibility that the toothbrush 102 becomes balanced in the strictly bristles down position shown in FIG. 15. That such balancing might otherwise occur can be seen from FIG. 13. In this position, the head section center of mass 122 (Mass "A") and the tail section center of mass 124 (Mass "B") both lie substantially vertically in line with the longitudinal axis 118 that is aligned with the pivot point 116 and extends perpendicularly to the direction of toothbrush rolling.

As can be seen in FIG. 16, with the protuberance 114E present on the frontward protrusion 114D, the entire pivot surface 114 may have an acorn-like cross-sectional shape. However, it will be appreciated that many other shapes could be used when configuring the medial section 108, including shapes with or without the protuberance 114E.

A further feature of the toothbrush embodiment 102 shown in FIG. 11 is that the rearward protrusion 114A may be distributed in the longitudinal direction. This is due to the fact that the tail section 106 of the toothbrush 102 may be formed with a slightly rearward lateral asymmetry 126 beginning at the medial section 108 and extending some distance toward the distal end of the tail section. This rearward lateral asymmetry 126 can be seen in FIGS. 14 and 18. It starts from the cross-section 16-16 of FIG. 14 and extends to the right end of the bracket that identifies the span of the rearward protrusion 114A. At the tail end of the rearward protrusion 114A, the toothbrush may have a slight forward curvature 128 before resuming a rearwardly angled orientation to provide the rearward lateral asymmetry 112. Both of the asymmetries 126 and 112 contribute to shifting the tail section 106 and its center of mass 124 in the rearward direction 113. As shown in FIGS. 13-15 and 18, the rearward protrusion 114A may include a set of ridges 130. The ridges 130 may be optionally provided if it is desired to increase the height of the rearward protrusion 114A without increasing the overall thickness of the toothbrush 102 in this vicinity. The ridges 130 may also be used as a forefinger grip by a toothbrush user.

As can be seen in FIG. 16, the rearward protrusion 114A may be relatively flat, which further contributes to the acorn-like cross-sectional shape of the overall pivot surface 114. Making the rearward protrusion 114A somewhat flat helps stabilize the toothbrush 102 in the bristles up position and prevents excessive rocking as the toothbrush assumes that position.

As can be seen in FIG. 14, the rearward protrusion 114A allows the distal end of the head section 104 to be raised off the support surface 120 when the toothbrush 102 is in the bristles up position. If the rearward protrusion 114A raises the distal end of the head section 104 high enough, the base portion of the head section 104 that extends from the pivot point 116 may be angled slightly rearwardly. This is shown in FIG. 14, with the base portion of the head section 104 being labeled by reference number 132. Providing the head section base portion 132 with a rearward angle correspondingly shifts the head section center of mass 122 in the rearward direction. As described below in connection with FIG. 18, this may advantageously result in the head section center of mass 122 being aligned with the longitudinal axis 118 in the bristles sideways position of FIG. 18, such that the head section center of mass offers no resistance to pivoting/rolling to the bristles up position. By further angling the head section base portion 132 in the rearward direction, it may be possible to shift the head section center of mass 122 so that it lies on the same side of the longitudinal axis 118 as the tail section center of mass 124. In that case, both centers of mass would induce pivoting/rolling to the bristles up position.

It should be understood that the tail section's rearward lateral asymmetry 126 and/or the ridges 130 of the rearward protrusion 114A may be reduced in size or even eliminated. For example, although not shown, the rearward protrusion 114A could be substantially flat and with no ridges. In that case, the head section base portion 132 may be configured with a slight forward angle if it is desired to prevent the distal end of the head section 104 from touching the contact surface 120.

Figure 18:
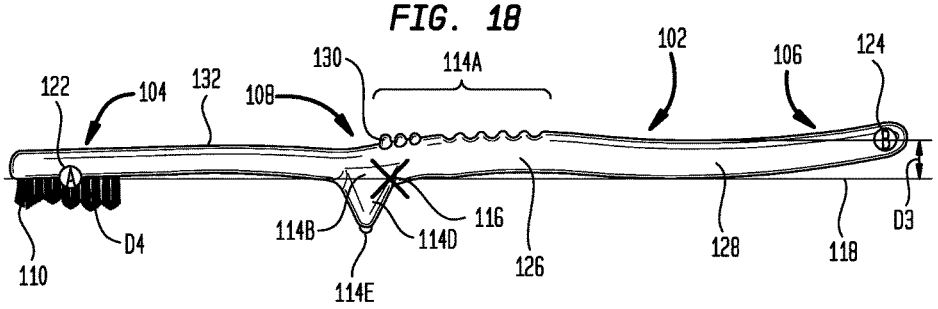
FIG. 18 is a plan view of the toothbrush of FIG. 1 positioned as in FIG. 17 with a side edge of the toothbrush resting on the support surface in a non-bristles up position.

Turning now to FIG. 18, the toothbrush 102 is shown in a non-bristles up position in which the bristles are oriented generally horizontally. In this bristles sideways position, the tail section center of mass 124 assumes a non-neutral unstable position in which it is not vertically in line with the longitudinal axis 118. In particular, the tail section center of mass 124 is laterally spaced from the longitudinal axis 18 by a distance "D3." The head section center of mass 122 is shown in FIG. 18 as being in line with the longitudinal axis, such that its spacing distance "D4"=0. In this configuration, the head section rotational moment (MomentA), which equals MassA×D4, is zero and has no effect on toothbrush rotation in the position shown in FIG. 18. The tail section rotational moment (MomentB), which equals MassB×D3, urges the toothbrush 102 to pivot toward the bristles up position.

The foregoing configuration is for purposes of example only, and it will be understood that the head section center of mass 122 could also be laterally offset from the longitudinal axis 18, either on the same or opposite side as the tail section center of mass 124. As long as the tail section MomentB is larger than the head section MomentA, and remains so as the toothbrush 102 pivots and rolls, the toothbrush will rotate from a non-bristles up position to a bristles up position.

FIGS. 19A-H and 20A-H illustrate this condition being satisfied as the toothbrush pivots and rolls through different positions on the support surface 120. During such rotation, the rotational moments induced by the head section center of mass 122 and the tail section center of mass 124 will change, but the head section MomentA is always less than the tail section MomentB. FIGS. 19A-H are end views of the toothbrush 102 looking toward the head section 104. For clarity, the bristles 110 are not shown. FIGS. 20A-H are end views of the toothbrush 102 looking toward the tail section 106.

FIGS. 19A-C and 20A-C show a first rotational sequence in which the toothbrush 102 starts from a bristles sideways position and ends in a bristles up position. FIGS. 19D-H and 20D-H show a second rotational sequence in which the toothbrush 102 starts from a bristles down position, passes through a bristles sideways position, and ends in a bristles up position.

Figure 19A:
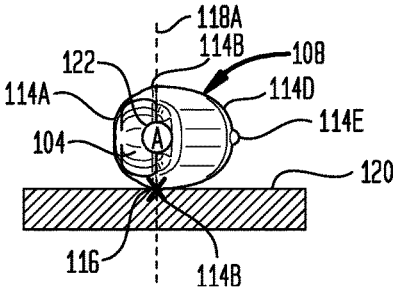
FIGS. 19A-19H are end views taken from the head end of the toothbrush of FIG. 12 and showing different rotational positions of the toothbrush about a central axis of rotation.
Figure 20A:
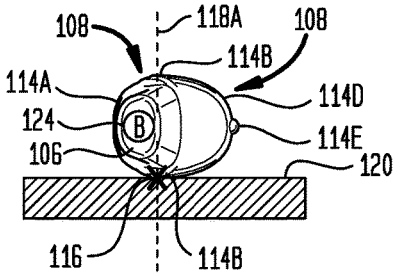
FIGS. 20A-20H are end views taken from the tail end of the toothbrush of FIG. 12 and showing different rotational positions of the toothbrush about a central axis of rotation.

FIGS. 19A and 20A depict the toothbrush 102 in a bristles sideways position as exemplified by FIG. 18. If the bristles were depicted in FIG. 19A, they would extend from the head section 104 in the right-hand direction and would be parallel to the support surface 120. The medial section 108 contacts the support surface 120 at a pivot point 116 located at one of the lateral protrusions 114B. As shown in FIG. 19A, the head section center of mass 122 lies substantially in a vertical plane 118A that extends through the longitudinal axis 118 (and the pivot point 116), such that the head section MomentA is approximately zero. As shown in FIG. 20A, the tail section center of mass 125 is laterally spaced from the vertical plane 118A on the left side thereof, such that the tail section MomentB is a non-zero value tending to impart counterclockwise rotation to the toothbrush 102 so that it is urged to roll toward the bristles up position.

Figure 19B:
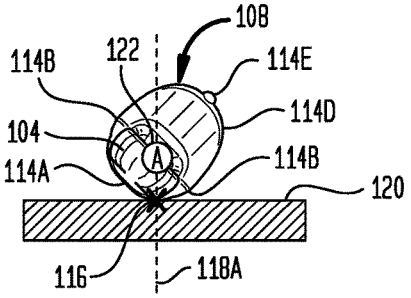
Figure 20B:
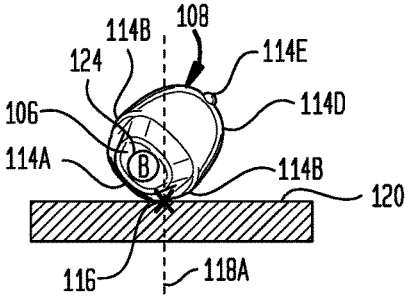

FIGS. 19B and 20B depict the toothbrush 102 in a non-bristles up position after rotating 45 degrees in the counterclockwise direction from the bristles sideways position shown in FIGS. 19A and 20A. If the bristles were depicted in FIG. 19B, they would extend from the head section 104 at a 45 degree angle. The medial section 108 contacts the support surface 120 at a pivot point 116 located between the rearward protrusion 114A and the lateral protrusion 114B that contacted the support surface in FIGS. 19A and 20A. As shown in FIG. 19B, the head section center of mass 122 lies substantially in the vertical plane 118A, such that the head section MomentA is approximately zero. As shown in FIG. 20B, the tail section center of mass 125 is laterally spaced from the vertical plane 118A on the left side thereof, such that the tail section MomentB is a non-zero value tending to impart counterclockwise rotation to the toothbrush 102 so that it is urged to roll toward the bristles up position.

Figure 19C:
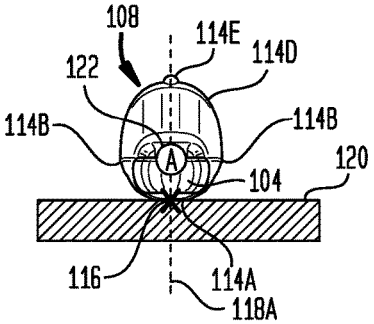
Figure 20C:
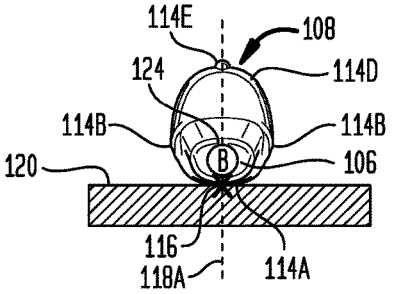

FIGS. 19C and 20C depict the toothbrush 102 in a bristles up position as exemplified by FIG. 14 after rotating 45 degrees in the counterclockwise direction from the position shown in FIGS. 19B and 20B. If the bristles were depicted in FIG. 19C, they would extend from the head section 104 in the vertical upward direction and perpendicular to the support surface 120. The medial section 108 contacts the support surface 120 at a pivot point 116 located at the rearward protrusion 114A. As shown in FIG. 19C, the head section center of mass 122 lies substantially in the vertical plane 118A, such that the head section MomentA is zero. As shown in FIG. 20C, the tail section center of mass 125 also lies substantially in the vertical plane 118A, such that the tail section MomentB is likewise zero. The toothbrush 102 is rotationally stable and will remain in the bristles up position.

Figure 19D:
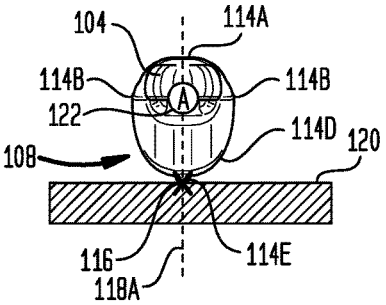
Figure 20D:
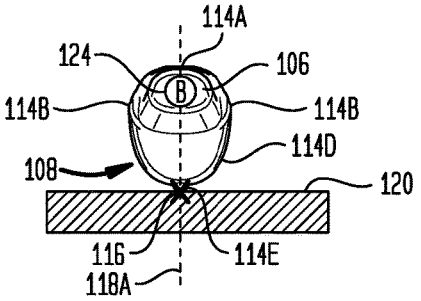

FIGS. 19D and 20D depict the toothbrush 102 in a bristles down starting position as exemplified by FIG. 15. If the bristles were depicted in FIG. 19D, they would extend from the head section 104 in the vertical downward direction and would be perpendicular to the support surface 120. The medial section 108 contacts the support surface 120 at a pivot point 116 located at the tip of the protuberance 114E on the frontward protrusion 114D. As shown in FIG. 19D, the head section center of mass 122 lies substantially in the vertical plane 118A, such that the head section MomentA is zero. As shown in FIG. 20D, the tail section center of mass 125 also lies substantially in the vertical plane 118A, such that the tail section MomentB is likewise zero. The toothbrush 102 is rotationally unstable due to the raised position of the head section center of mass 122 and the tail section center mass 124 (relative to their positions in the stable position of FIGS. 19C and 20C). Any slight rotation of the toothbrush 102 from the position of FIGS. 19D and 20D will laterally offset the head section center of mass 102 and the tail section center of mass 104 from the vertical plane 118A, immediately creating a rotational moment that induces toothbrush rotation. This is in contrast to the stable position of FIGS. 19C and 20C, in which any slight rotation of the toothbrush 102 is countered by an opposing rotational moment imparted by the tail section center of mass 124. As previously discussed, the rotational instability of the toothbrush in the position of FIGS. 19D and 20D is further assisted by the protuberance 114E.

Figure 19E:
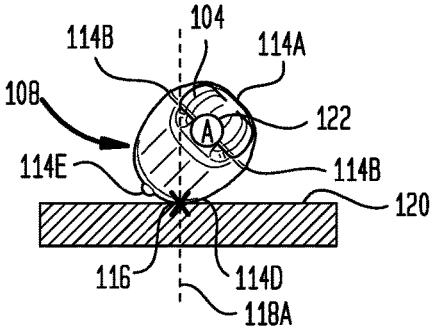
Figure 20E:
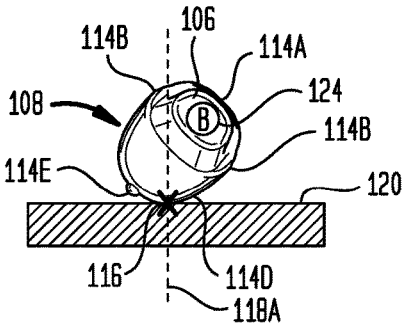

FIGS. 19E and 20E depict the toothbrush 102 in a non-bristles up position after rotating 45 degrees in the clockwise direction from the bristles down position shown in FIGS. 19D and 20D. If the bristles were depicted in FIG. 19E, they would extend from the head section 104 at a 225 degree angle. The medial section 108 contacts the support surface 120 at a pivot point 116 located between the frontward protrusion 114D and one of the lateral protrusions 114B. As shown in FIG. 19E, the head section center of mass 122 is offset from the vertical plane 118A on the right side thereof, such that the head section MomentA is a non-zero value tending to impart clockwise rotation to the toothbrush so that it is urged to roll toward the bristles up position. As shown in FIG. 20E, the tail section center of mass 125 is laterally spaced from the vertical plane 118A on the right side thereof, such that the tail section MomentB is a non-zero value also tending to impart clockwise rotation to the toothbrush 102 so that it is urged to roll toward the bristles up position.

Figure 19F:
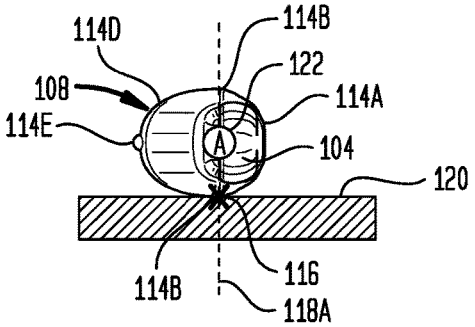
Figure 20F:
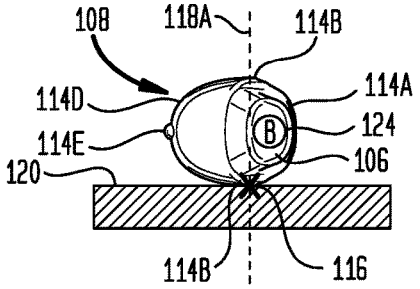

FIGS. 19F and 20F depict the toothbrush 102 in a bristles sideways position as exemplified by FIG. 18. If the bristles were depicted in FIG. 19F, they would extend from the head section 104 in the left-hand direction and would be parallel to the support surface 120. The medial section 108 contacts the support surface 120 at a pivot point 116 located at one of the lateral protrusions 114B. As shown in FIG. 19F, the head section center of mass 122 lies substantially in the vertical plane 118A, such that the head section MomentA is approximately zero. As shown in FIG. 20F, the tail section center of mass 125 is laterally spaced from the vertical plane 118A on the right side thereof, such that the tail section MomentB is a non-zero value tending to impart clockwise rotation to the toothbrush 102 so that it is urged to roll toward the bristles up position.

Figure 19G:
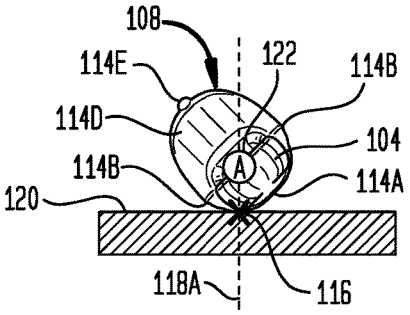
Figure 20G:
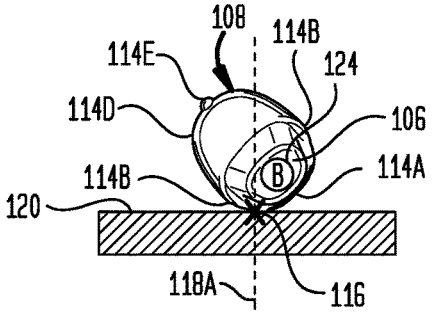

FIGS. 19G and 20G depict the toothbrush 102 in a non-bristles up position after rotating 45 degrees in the clockwise direction from the bristles sideways position shown in FIGS. 19F and 20F. If the bristles were depicted in FIG. 19G, they would extend from the head section 104 at a 135 degree angle. The medial section 108 contacts the support surface 120 at a pivot point 116 located between the rearward protrusion 114A and the lateral protrusion 114B that contacted the support surface in FIGS. 19F and 20F. As shown in FIG. 19G, the head section center of mass 122 lies substantially in the vertical plane 118A, such that the head section MomentA is approximately zero. As shown in FIG. 20G, the tail section center of mass 125 is laterally spaced from the vertical plane 118A on the right side thereof, such that the tail section MomentB is a non-zero value tending to impart clockwise rotation to the toothbrush 102 so that it is urged to roll toward the bristles up position.

Figure 19H:
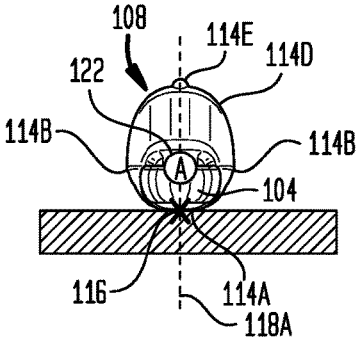
Figure 20H:
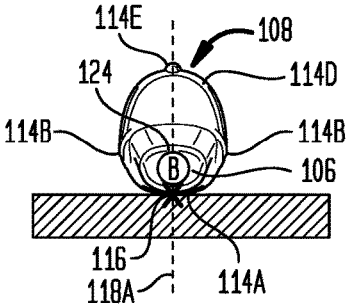

FIGS. 19H and 20H depict the toothbrush 102 in a bristles up position as exemplified by FIG. 14 after rotating 45 degrees in the clockwise direction from the position shown in FIGS. 19G and 20G. If the bristles were depicted in FIG. 19H, they would extend from the head section 104 in the vertical upward direction and perpendicular to the support surface 120. The medial section 108 contacts the support surface 120 at a pivot point 116 located at the rearward protrusion 114A. As shown in FIG. 19H, the head section center of mass 122 lies substantially in the vertical plane 118A, such that the head section MomentA is zero. As shown in FIG. 20H, the tail section center of mass 125 also lies substantially in the vertical plane 118A, such that the tail section MomentB is likewise zero. The toothbrush 102 is rotationally stable and will remain in the bristles up position.

Accordingly, embodiments of a self-righting toothbrush have been disclosed. The self-righting feature naturally pivots the toothbrush to its bristles up position. This isolates the bristles from the support surface in most instances when the toothbrush is dropped or placed onto the support surface. The toothbrush does so by harnessing the benefits of rotational inertia by utilizing the formula W (weight) times A (arm) equals Moment, the same basic formula used for aircraft balancing. The toothbrush utilizes the foregoing formula to provide a design that will naturally be at an equilibrium state with the toothbrush resting in the bristles up position.

Advantageously, the toothbrush has the appearance of a traditional toothbrush and can be designed to fit into any traditional toothbrush holder. In addition, there is no learning curve to it use. As the toothbrush is placed or even tossed on the support surface, it will automatically self orient itself into the desired bristles up position.

Although example embodiments of the disclosed subject matter have been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. A self-righting toothbrush, comprising:

a head section, a tail section and a medial section, said medial section being disposed at a junction of said head section and said tail section in a longitudinal direction of said toothbrush;

said head section mounting a set of bristles that extend in a frontward direction;

said tail section having a rearward lateral asymmetry that extends in a rearward direction that is generally opposite to said frontward direction;

said medial section having a pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush;

said head section and said tail section having a respective head section center of mass and a tail section center of mass;

said toothbrush being in a stable orientation when said toothbrush is in a bristles up position in which said bristles extend vertically away from said support surface, and wherein said head section center of mass and said tail section center of mass are substantially aligned in said vertical plane;

said tail section center of mass being laterally spaced from said vertical plane due to said rearward lateral asymmetry so as to assume non-neutral unstable positions when said toothbrush is in a non-bristles up position with said bristles extending in a non-vertical direction;

said non-neutral position of said tail section center of mass producing a net rotational moment that tends to induce said toothbrush to roll to said bristles up position; and said pivot surface remaining in contact with said support surface at all rolling positions of said toothbrush.

2. The toothbrush of claim 1, wherein said head section center of mass is laterally spaced from said vertical plane so as to assume non-neutral unstable positions at one or more positions in which said toothbrush is in a non-bristles up position with said bristles extending in a non-vertical direction.

3. The toothbrush of claim 2, wherein said head section center of mass and said tail section center of mass are laterally spaced on opposite sides of said vertical plane in said one or more positions.

4. The toothbrush of claim 3, wherein said tail section center of mass creates a rotational moment that is larger than and in opposition to a rotational moment created by said head section center of mass.

5. The toothbrush of claim 2, wherein said head section center of mass and said tail section center of mass are laterally spaced on the same side of said vertical plane in said one or more positions.

6. The toothbrush of claim 1, wherein said head section does not contact said support surface when said toothbrush is in said bristles up position.

7. The toothbrush of claim 1, wherein said head section does not contact said support surface when said toothbrush is in a bristles down position in which said bristles extend vertically toward said support surface, or at any other rotational position of said toothbrush.

8. A self-righting toothbrush, comprising:

a head section, a tail section and a medial section, said medial section being disposed at a junction of said head section and said tail section in a longitudinal direction of said toothbrush;

said head section mounting a set of bristles that extend in a frontward direction;

said tail section having a rearward lateral asymmetry that extends in a rearward direction that is generally opposite to said frontward direction;

said medial section having a pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush;

said head section and said tail section having a respective head section center of mass and a tail section center of mass;

said toothbrush being in a stable orientation when said toothbrush is in a bristles up position in which said bristles extend vertically away from said support surface, and wherein said head section center of mass and said tail section center of mass are substantially aligned in said vertical plane;

said tail section center of mass being laterally spaced from said vertical plane due to said rearward lateral asymmetry so as to assume non-neutral unstable positions when said toothbrush is in a non-bristles up position with said bristles extending in a non-vertical direction;

said non-neutral position of said tail section center of mass producing a net rotational moment that tends to induce said toothbrush to roll to said bristles up position;

said pivot surface remaining in contact with said support surface at all rolling positions of said toothbrush; and said pivot surface comprising a rearward protrusion, a lateral protrusion on each side of said rearward protrusion, and a frontward protrusion, said rearward protrusion, said lateral protrusions and said frontward protrusion forming a substantially continuous curve of selected shape.

9. The toothbrush of claim 8, wherein said frontward protrusion is generally dome-shaped and sized to prevent said head section from contacting said support surface when said toothbrush is in a bristles down position in which said bristles extend vertically toward said support surface.

10. The toothbrush of claim 8, wherein said frontward protrusion comprises a protuberance at a central peak portion thereof to provide rotational instability when said toothbrush in a bristles down position in which said bristles extend vertically toward said support surface.

11. The toothbrush of claim 8, wherein said frontward protrusion comprises a concavity on a tail-end surface thereof that faces said tail section.

12. The toothbrush of claim 8, wherein rearward protrusion is longitudinally distributed.

13. The toothbrush of claim 12, wherein said rearward protrusion comprises one or more ridges.

14. The toothbrush of claim 12, wherein said rearward protrusion extends sufficiently rearwardly to allow a base portion of said head section to angle rearwardly.

15. The toothbrush of claim 12, wherein said rearward protrusion comprises a rearward lateral asymmetry of said toothbrush.

16. A self-righting toothbrush, comprising:

a head section, a tail section and a medial section, said medial section being disposed at a junction of said head section and said tail section in a longitudinal direction of said toothbrush;

said head section mounting a set of bristles that extend in a frontward direction;

said tail section having a rearward lateral asymmetry that extends in a rearward direction that is generally opposite to said frontward direction;

said medial section having a pivot surface configured to contact a horizontal support surface at a pivot point, said pivot surface allowing said toothbrush to roll on said support surface;

said pivot point lying on said pivot surface and representing its instantaneous point of contact with said support surface at any given rotational position of said toothbrush, said pivot point lying in a vertical plane that is substantially perpendicular to a rolling direction of said toothbrush;

said head section and said tail section having a respective head section center of mass and a tail section center of mass;

said toothbrush being in a stable orientation when said toothbrush is in a bristles up position in which said bristles extend vertically away from said support surface, and wherein said head section center of mass and said tail section center of mass are substantially aligned in said vertical plane;

said tail section center of mass being laterally spaced from said vertical plane due to said rearward lateral asymmetry so as to assume non-neutral unstable positions when said toothbrush is in a non-bristles up position with said bristles extending in a non-vertical direction;

said non-neutral position of said tail section center of mass producing a net rotational moment that tends to induce said toothbrush to roll to said bristles up position;

said pivot surface remaining in contact with said support surface at all rolling positions of said toothbrush;

said pivot surface comprising a rearward protrusion, a lateral protrusion on each side of said rearward protrusion, and a frontward protrusion, said rearward protrusion, said lateral protrusions and said frontward protrusion forming a continuous curve of selected shape; and said frontward protrusion comprising a protuberance at a central peak thereof to provide rotational instability when said toothbrush in a bristles down position in which said bristles extend vertically toward said support surface.

17. The toothbrush of claim 16, wherein said pivot surface comprises a generally acorn-like cross-sectional configuration.

18. The toothbrush of claim 16, wherein said frontward protrusion is generally dome-shaped and sized to prevent said head section from contacting said support surface when said toothbrush is in a bristles down position in which said bristles extend vertically toward said support surface.

19. The toothbrush of claim 16, wherein said frontward protrusion comprises a concavity on a tail-end surface thereof that faces said tail section.

20. The toothbrush of claim 16, wherein said frontward protrusion is convex on a head-end side thereof that faces said head section.

* * * * *